United States Patent [19]

Frosch

[11] Patent Number: 4,905,494

[45] Date of Patent: Mar. 6, 1990

[54] APPARATUS FOR AXIALLY SLIDABLY POSITIONING ROLL BEARING SUPPORTS IN THE HOUSING WINDOW OF A STAND OF A MULTIROLL MILL

[75] Inventor: Hans Frosch, Neuss, Fed. Rep. of Germany

[73] Assignee: SMS Schloemann-Siemag Aktiengesellschaft, Düsseldorf, Fed. Rep. of Germany

[21] Appl. No.: 209,341

[22] Filed: Jun. 20, 1988

[30] Foreign Application Priority Data

Jun. 22, 1987 [DE] Fed. Rep. of Germany ..... 3720545

[51] Int. Cl.[4] ..... B21B 31/18

[52] U.S. Cl. ..... 72/247; 72/237

[58] Field of Search ..... 72/237, 238, 247, 245

[56] References Cited

U.S. PATENT DOCUMENTS 4,693,106 9/1987 Frosch ..... 72/247
4,736,609 4/1988 Schiller et al. ..... 72/247
4,744,235 5/1988 Schiller ..... 72/238

FOREIGN PATENT DOCUMENTS 3409221 9/1985 Fed. Rep. of Germany .
8614518 8/1986 Fed. Rep. of Germany .
3525462 1/1987 Fed. Rep. of Germany .
60-259911 12/1985 Japan .

*Primary Examiner*—Lowell A. Larson
*Assistant Examiner*—Thomas C. Schoeffler
*Attorney, Agent, or Firm*—Herbert Dubno

[57] ABSTRACT

The apparatus for axially slidably positioning a plurality of roll bearing supports guided in the housing windows of the stands of a mill comprises a plurality of guide members each mounted in at least one rigid supporting frame and each pivotable about an axle oriented transversely to the roll axle direction, at least two traversing carriages guided in at least two of the guide members which are each drivable by a drive motor and coupling means for releasable engagement or linkage of each of the traversing carriages with an associated roll bearing support. One of the supporting frames of a supporting frame pair with frame planes arranged substantially perpendicular to the rolling plane and substantially parallel to each other is mounted on each stand of a stand pair in the rolling mill and the coupling means of the traversing carriages of one and another of the guide members are connectable with a side of one of the roll bearing supports facing that traversing carriage or supporting frame.

4 Claims, 4 Drawing Sheets

APPARATUS FOR AXIALLY SLIDABLY POSITIONING ROLL BEARING SUPPORTS IN THE HOUSING WINDOW OF A STAND OF A MULTIROLL MILL

FIELD OF THE INVENTION

My present invention relates to an apparatus for axially slidably positioning a plurality of roll bearing supports guided in the housing windows of the stand of a multiroll rolling mill stand.

BACKGROUND OF THE INVENTION

An apparatus for axially slidably positioning a plurality of roll bearing supports guided in the housing windows of the stands of a multiroll rolling mill can comprise a plurality of guide members each mounted in at least one rigid supporting frame and each pivotable about an axis oriented transversely to the roll axis direction, a pair of traversing carriages guided in respective guide members which are then displaceable by a respectable lifting (jack-type) motor and coupling means for releasable engagement or linkage of the traversing carriages with the associated roll bearing supports.

With this apparatus with the help of the drive motors which provide the pivoting motion of the guide members pivotally mounted in the rigid supporting frame, the sliding force originating from the drive motor driving the traversing carriages is aligned directly on the center axis of the roll involved in every position of the roll held by the roll bearing support.

In the apparatus described in German Open Application DE-OS 35 25 462 the guide members for the traversing carriages associated with the roll bearing supports are pivoted on a common ridge supporting frame whose frame plane runs parallel to the rolling plane and the coupling means provided on the traversing carriages comprise a pair of clamp jaws or pincers mounted pivotally on the carriage transverse to the roll axle direction. The clamp jaws have hook-like clamp jaw ends insertable and withdrawable from suitable recesses of both sides in the roll bearing support.

This apparatus must comparatively wide since the inner open width of the supporting frame must correspond to the width of the housing window and the mechanism occupies the entire space behind the outer front surface of the roll bearing support outside of the roll stand and hinders access to the roll bearing support as well as the addition of other devices and units necessary for operation of these parts.

The apparatus thus can be used only for axially sliding of certain roll groups on the service side of a roll stand in which such hindrances and/or difficulties can be endured.

This apparatus is not usable on the driven side of the rolls since the supporting frame guide members and the traversing carriages would be located in the space required for the drive transmission elements.

OBJECTS OF THE INVENTION

It is an object of my invention to provide an improved apparatus for axially slidably positioning a plurality of roll bearing supports in a many-roll rolling mill, especially in a housing window of a stand of a multiroll rolling mill stand, in which the above mentioned disadvantages are avoided.

It is also an object of my invention to provide an improved apparatus for axially slidably positioning a plurality of roll bearing supports in a window a multiroll rolling mill stand, which is usable with working rolls, intermediate rolls and if necessary also supporting rolls or backup in each roll group of the multi-stand assembly of rolls and as desired independently of whether the roll shifting mechanism is located on the service or the driven side of the rolls.

SUMMARY OF THE INVENTION

These objects and others which will become more readily apparent hereinafter are attained in accordance with my invention in an apparatus for axially slidably positioning a plurality of roll bearing supports guided in a housing window of a multiroll rolling mill stand and comprising a plurality of guide members each mounted in at least one rigid supporting frame and each pivotable about an axis oriented transversely to the roll axis direction, at least two traversing carriages guided in at least two guide members which are each drivable by a stroke-type drive motor and coupling means for releasable connection of the traversing carriages with the associated roll bearing support.

According to my invention a pair of supporting frames with frame planes positioned substantially perpendicular to the rolling plane and substantially parallel to each other is mounted on each of the stands of a stand pair of the multiroll mill and the coupling means of the traversing carriages of the two guide members in these frames of each stand are connectable with a side of the roll bearing supports facing the traversing carriages.

In this structure, because each upright flanking a window of the respective stand has one such frame and the frame planes coincide with the planes of the uprights, the space behind the front surface of the roll bearing support laterally outside the roll stand and between each frame pair is available for operation of the roll stand, for building in operator assisting devices, e.g. for automatic operation of the roll stand or for the drive transmission elements of the rolls, e.g. linkage spindles.

When as provided further by my invention the coupling means of the respective traversing carriage has a rotatable bolt in it insertable and withdrawable from a recess in each of the adjacent roll bearing supports, the coupling means need not be furnished with an additional guiding support or link member running transverse to the roll axis direction since the bolt rotatable in the roll bearing support forms this rotary bearing or support with the result that the apparatus can not only be simply assembled but also is considerably shorter than previous roll shifting setups.

My invention further provides that the guide members can be mounted in an overhung or cantilever or floating arrangement on a rotating axis seated in the supporting frame. The stroke-type drive motor of the traversing carriage can comprise a piston-cylinder unit whose piston rod is aligned with the axis of the rotating axis of the guide member and whose cylinder is combined radially with a guide sleeve of the bolt with another piston-cylinder unit whose piston rod displaces the bolt. These cylinder assemblies form the traversing carriages.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
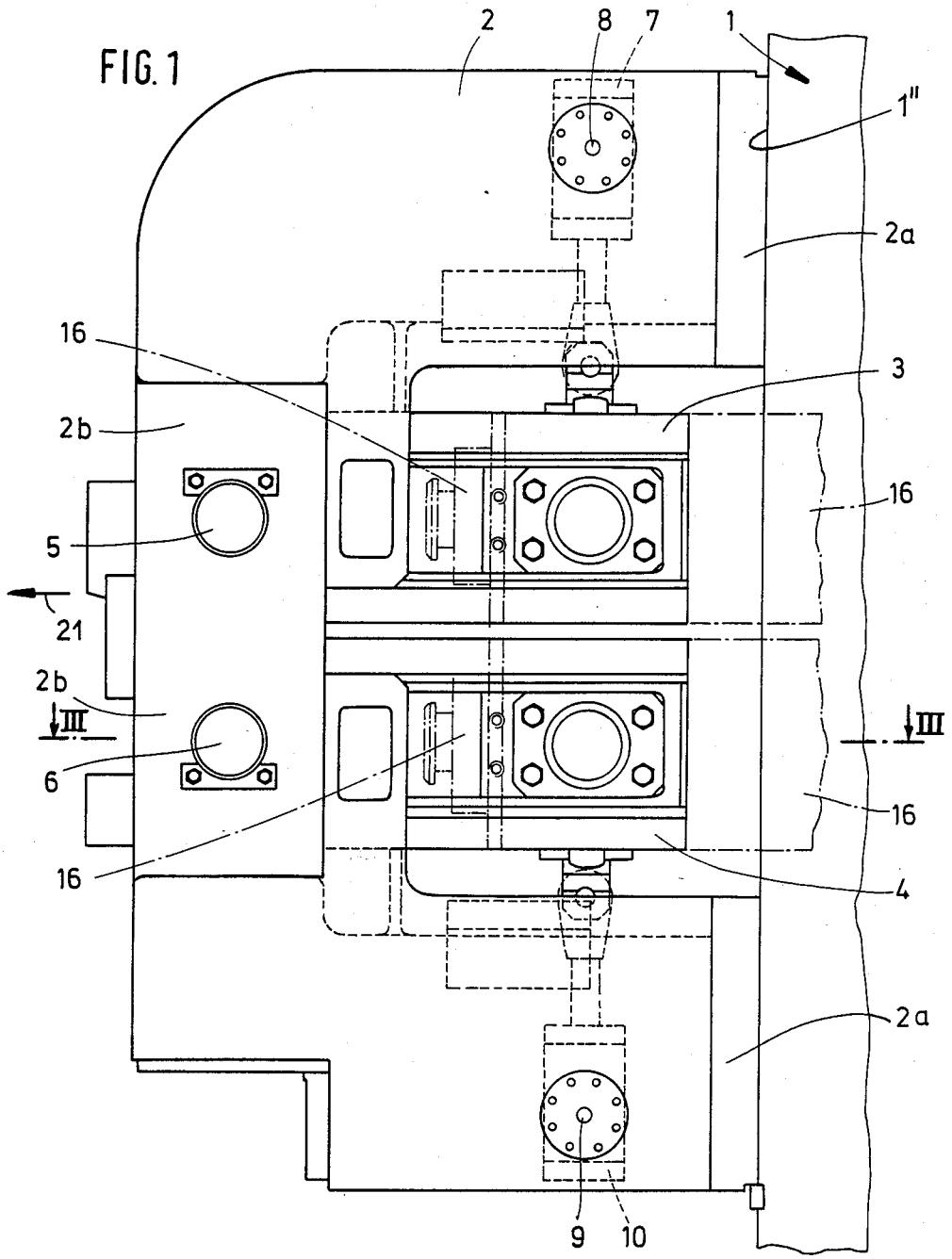
FIG. 1 is an elevational view taken in the rolling direction of an apparatus for axially slidably positioning roll bearing supports in the housing windows of the stands of a multiroll mill according to my invention.
Figure 2:
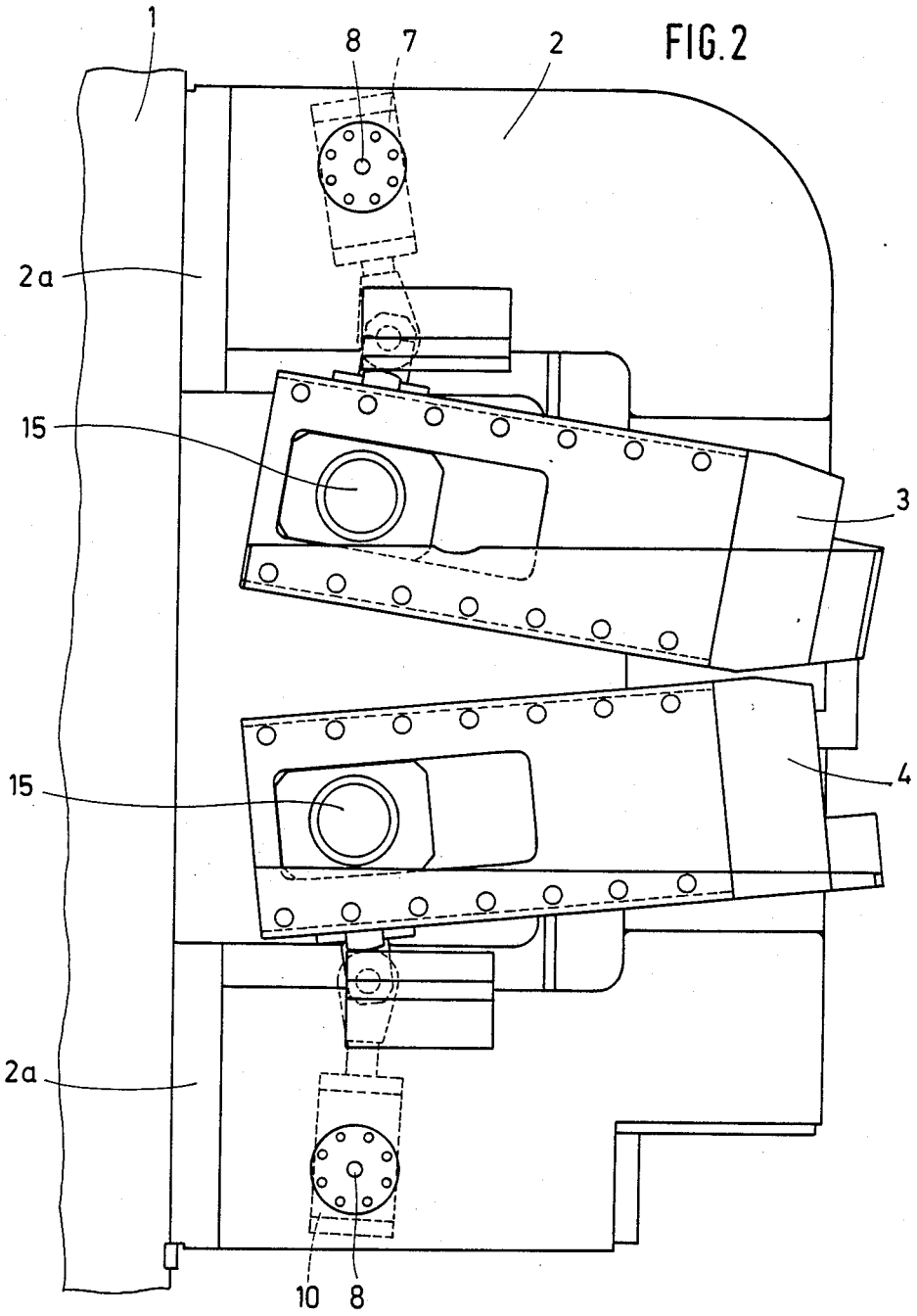
FIG. 2 is a rear elevational view of the apparatus shown in FIG. 1.

As is apparent from FIGS. 1 and 2 the supporting frame 2 formed in the shape of a U-bar is attached with its U-legs 2*a* to one of the uprights 1" of the stand 1 having the housing window 1' between the uprights.

Adjacent upper and lower guide members 3 and 4 spaced from each other vertically are mounted on the U-crosspiece 2*b* of the supporting frame 2 so as to pivot on the upper and lower axis 5 and 6 both oriented substantially transversely to the roll axis direction indicated by the arrow 21.

Figure 3:
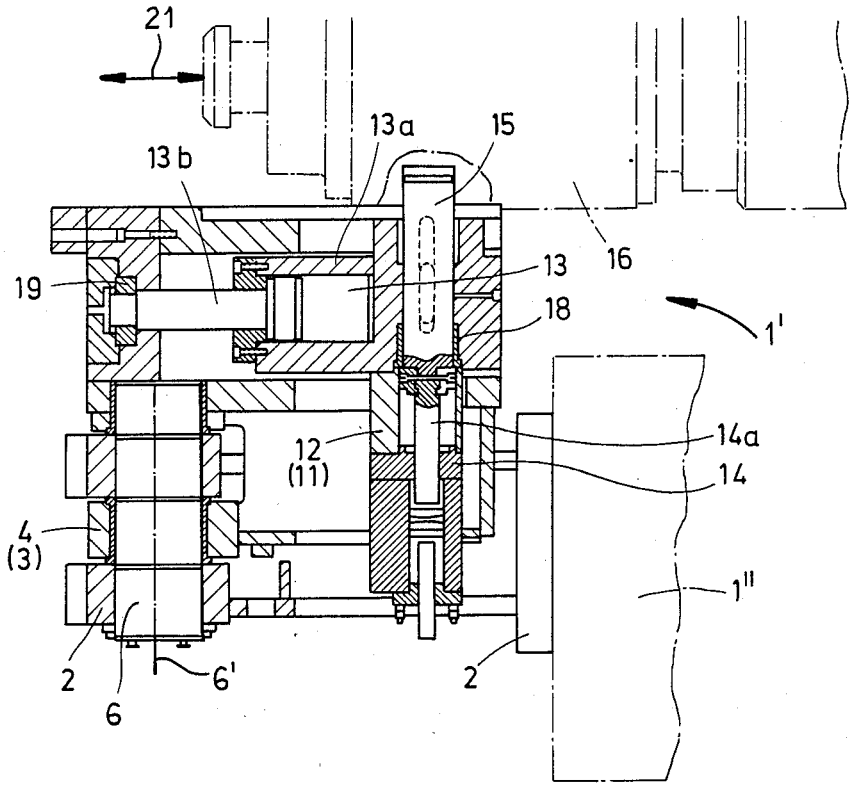
FIG. 3 is a cross sectional view through the apparatus of FIG. 1 taken along the section line III—III of FIG. 1 but showing only one coupling unit.
Figure 4:
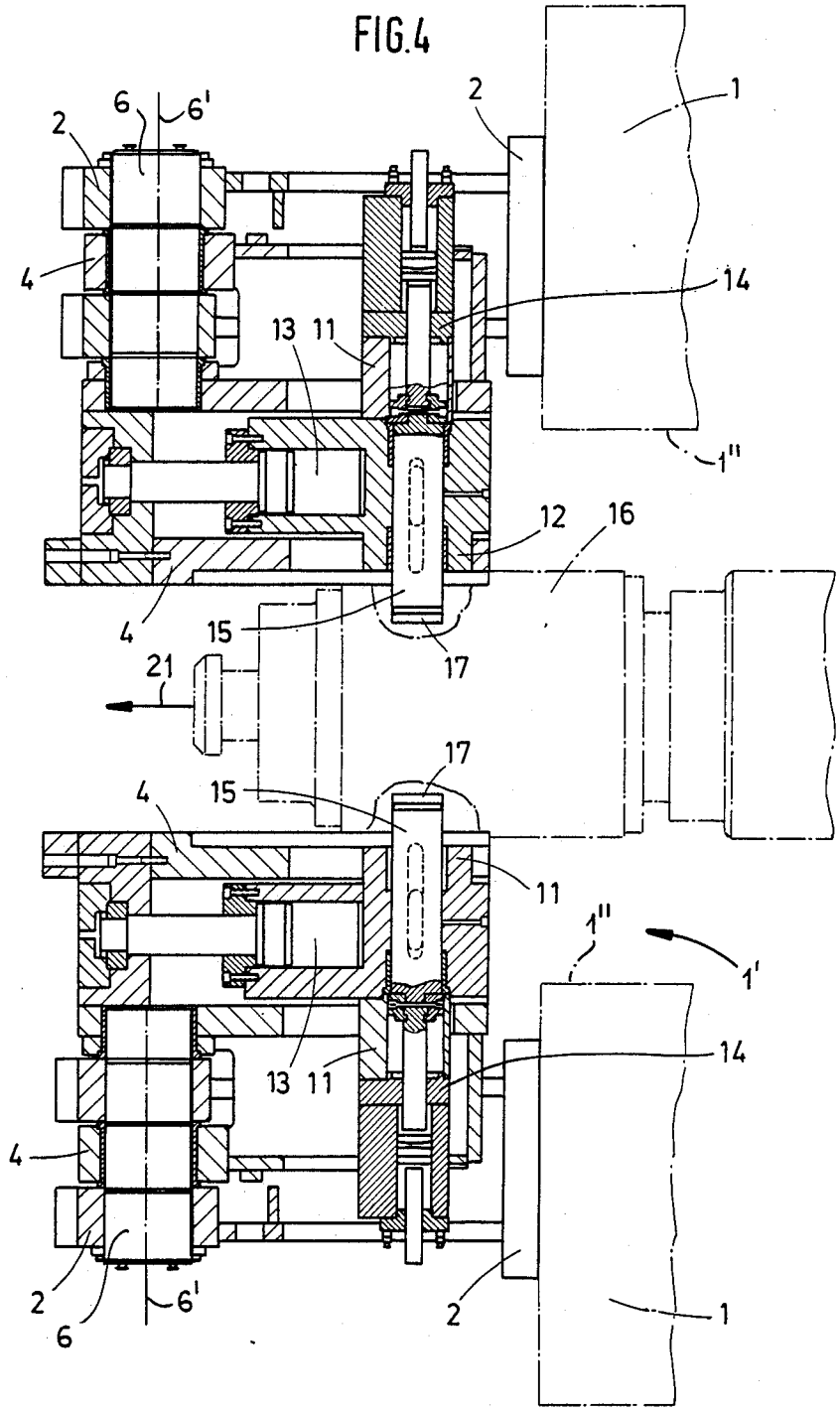
FIG. 4 is a cross sectional view along the same line showing both coupling units.

As can be seen from FIGS. 3 and 4, the bulk of the guides 3 and 4 are cantilevered inwardly on the shafts defining the axes 5 and 6.

The upper guide member 3 hangs from a piston-cylinder device 7, which is pivotally mounted on the pivot 8 in the upper U-leg 2*a* of the supporting frame 2.

The lower guide member 4 is supported by a piston-cylinder device 10 which is pivotally mounted on a pivot 9 in the lower U-leg 2*a* of the supporting frame 2.

A traversing carriage 11, 12 is guided in the respective guide member 3, 4 (see FIG. 4) and is slidable transverse to the axis 5 and/or 6 by respective piston-cylinder units 13.

Each piston-cylinder unit 13 carries a bolt 15 slidable parallel to the axis 5 and/or 6 by another piston-cylinder unit 14.

The supporting frames 2 are, as shown in FIG. 4, arranged as a supporting frame pair with respective frame planes positioned perpendicular to the rolling plane and parallel to each other on the two uprights 1" straddling the window 1' of the respective stand 1.

Between both supporting frames 2 and the guide member 4 of each supporting frame 2 connected to it a roll bearing support 16 to be slid axially is located and is provided with lateral recesses 17 in which the bolts 15 located on the traversing carriages 11 and/or 12 can be inserted laterally.

These bolts 15 can engage from opposite sides in the roll bearing support 16. This coupling means between the traversing carriages 11, 12 and the roll bearing support 16 is activated with the help of the piston-cylinder devices 7 and 10 when the upper guiding member 3 and the lower guiding member 4 are moved into the extended position shown in FIG. 2.

During rolling operations the piston-cylinder devices 7 and 10 are acted on with a pressure of predetermined magnitude which remains substantially constant and brings about a weight balancing in regard to the weight of the guide members 3, 4 and their traversing carriages 11, 12 as well as the force components which result from an additional loading of the roll bearing supports 16 when they are located on the driven side. This weight compensation is of special significance since the additional positioning forces applied to the rolls and/or the roll bearing support, e.g. forces from the roll bending devices, which could be influenced negatively by such weights must be avoided.

The traversing carriages 11, 12, as is seen in FIG. 3, also are formed by the other piston-cylinder unit 14 on whose other piston rod 14*a* the bolt 15 guided in a coaxial guide sleeve 18 is carried. The cylinder 13*a* of the first piston-cylinder unit 13 whose piston rod 13*b* is attached at right angles to the rotating axis 6 of the traversing carriage 11 and/or 12 with a thrust nut 19 is oriented radially to the guide sleeve 18 approximately on the axis 6' of the axis 6. A boxlike guide member 4 and/or 3 is therefore mounted on each of the twin supporting frames 2 pivotable about the axis 6 and produces a particularly short structurally compact positioning drive unit of the special structure described above including the one piston-cylinder unit 13 as a positioning drive for the traversing carriages 12 and/or 11.

The housing window 1' is only indicated in part in the drawing.

The rolling plane referred to in the following is substantially the plane of FIG. 4 or a plane parallel to it.

I claim:

1. In an apparatus for axially slidably positioning a plurality of roll bearing supports guided in a housing window of a multiroll stand comprising a plurality of guide members mounted in at least one rigid supporting frame each pivotable about an axis oriented substantially transversely to a roll axis direction, traversing carriages respectively guided in said guide members and displaceable by a stroke-type drive motor and coupling means for releasable connection of said traversing carriages with associated ones of said roll bearing supports, the improvement wherein a pair of said supporting frames are provided with frame planes positioned substantially perpendicular to a rolling plane of said rolling mill and substantially parallel to each other, said frames being mounted on said stands of a stand on opposite stand uprights flanking a respective said window, and said coupling means of said traversing carriages arranged in said supporting frames are connectable with respective sides of one of said roll bearing supports facing said traversing carriage.

2. The improvement defined in claim 1 wherein said coupling means of each of said traversing carriages have a rotatable bolt mounted in each of said traversing carriages and each of said bolts is insertable in and withdrawable from a recess in one of said roll bearing supports.

3. The improvement defined in claim 1 wherein said guide members are mounted in cantilever arrangement on a rotating axis positioned in said supporting frame and said stroke-type drive motor of said traversing carriage comprises a piston-cylinder unit whose piston rod is seated or supported on the axis of said axis of said guide member having said traversing carriage and whose cylinder is forced radially with a guide sleeve of said bolt and together with another of said piston-cylinder units whose piston rod displaces said bolt, forms the respective traversing carriage.

4. An apparatus for axially slidably positioning at least two roll bearing supports guided in two housing windows of two stands of a roll stand pair of a many-roll rolling mill comprising:

at least two supporting frames of a supporting frame pair with frame planes positioned substantially perpendicular to a rolling plane of said rolling mill and substantially parallel to each other on each stand;

at least two traversing carriages each guided in a guide member mounted in each of said supporting frames, each of said guide members being pivotable about an axis oriented substantially transversely to the roll axis direction and each of said traversing carriages being drivable by one piston-cylinder unit whose one piston rod is seated or supported on the axis of said axis of said guide member having said traversing carriage and whose one cylinder combined radially with a guide sleeve for a rotatable bolt slidably mounted in said traversing carriage together with another of said piston-cylinder units whose other piston rod seats said rotatable bolt forms said traversing carriage; and coupling means for releasable engagement or for linkage of each of said traversing carriages with an associated one of said roll bearing supports comprising said bolt mounted in each of said traversing carriages which is insertable in and withdrawable from a recess in one of said roll bearing supports facing said traversing carriage.

* * * * *